US011637394B2

(12) United States Patent
Zhang et al.

(10) Patent No.: US 11,637,394 B2
(45) Date of Patent: Apr. 25, 2023

(54) ELECTRICAL CONNECTOR HAVING POWER CONTACTS ASSEMBLED IN A HEIGHT DIRECTION

(71) Applicant: ALLTOP ELECTRONICS (SUZHOU) LTD., Suzhou (CN)

(72) Inventors: Zhihui Zhang, Suzhou (CN); Dingbin Yin, Suzhou (CN)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 0 days.

(21) Appl. No.: 17/233,358

(22) Filed: Apr. 16, 2021

(65) Prior Publication Data

US 2021/0376516 A1 Dec. 2, 2021

(30) Foreign Application Priority Data

May 28, 2020 (CN) ..... 02010468940.9

(51) Int. Cl.
*H01R 13/424* (2006.01)
*H01R 12/58* (2011.01)
*H01R 12/72* (2011.01)

(52) U.S. Cl.
CPC ..... *H01R 13/424* (2013.01); *H01R 12/58* (2013.01); *H01R 12/724* (2013.01)

(58) Field of Classification Search
CPC ..... H01R 13/518; H01R 13/506; H01R 13/5045; H01R 13/11; H01R 13/113; H01R 13/424; H01R 13/41; H01R 13/428; H01R 12/58; H01R 12/721; H01R 12/722; H01R 12/724; H01R 12/727; H01R 12/73
USPC ..... 439/845, 850, 733.1, 752, 637
See application file for complete search history.

(56) References Cited

U.S. PATENT DOCUMENTS 6,890,221 B2 * 5/2005 Wagner ..... H01R 13/113 439/825
7,303,401 B2 * 12/2007 Schell ..... H01R 12/7088 439/856
7,354,282 B2 * 4/2008 Margulis ..... H01R 13/04 439/660

(Continued)

FOREIGN PATENT DOCUMENTS

DE 102013111571 A1 * 4/2015 ..... H01R 12/58
DE 202018103270 U1 * 2/2019
TW I271900 B * 1/2007

*Primary Examiner* — Marcus E Harcum
(74) *Attorney, Agent, or Firm* — Cheng-Ju Chiang

(57) ABSTRACT

An electrical connector includes an insulative housing and a plurality of power contact pairs, the insulative housing has a mounting section for installing on a printed circuit board, a mating section and a plurality of contact-receiving passageways extending along a front-and-back direction. The power contact pairs are retained in corresponding contact-receiving passageways and divided into two rows along a height direction, each power contact pair in each row has two flaky power contacts, each power contact has a retaining portion held in the relative contact-receiving passageway, at least one contacting portion extending forwards from the retaining portion and at least one soldering portion bending from a rear end of the retaining portion. One row of power contact pairs is assembled into the insulative housing along a back-to-front direction, and the other row of power contact pairs is assembled into the insulative housing in an up-and-down direction.

17 Claims, 9 Drawing Sheets

(56) References Cited

U.S. PATENT DOCUMENTS

| | | | | |
|---|---|---|---|---|
| 7,794,259 | B2 * | 9/2010 | Zhu | H01R 12/722 439/325 |
| 8,057,266 | B1 * | 11/2011 | Roitberg | H01R 13/055 439/907 |
| 8,262,395 | B2 * | 9/2012 | Ke | H01R 13/11 439/79 |
| 8,317,542 | B2 * | 11/2012 | Abraham | G06F 1/1662 439/607.31 |
| 8,419,477 | B1 * | 4/2013 | Yu | H01R 25/162 439/540.1 |
| 8,651,880 | B2 * | 2/2014 | Wu | H01R 13/112 439/79 |
| 8,814,605 | B2 * | 8/2014 | Yu | H01R 13/506 439/947 |
| 8,961,199 | B2 * | 2/2015 | Tai | H01R 12/724 439/79 |
| 9,136,652 | B2 * | 9/2015 | Ngo | H01R 24/00 |
| 9,257,768 | B2 * | 2/2016 | Hung | H01R 12/724 |
| 9,899,759 | B2 * | 2/2018 | Yu | H01R 13/113 |
| 9,960,514 | B1 * | 5/2018 | Chen | H01R 24/68 |
| 10,411,382 | B2 * | 9/2019 | Sichmann | H01R 13/113 |
| 10,553,973 | B2 * | 2/2020 | Copper | H01R 12/7088 |
| 2002/0098743 | A1 * | 7/2002 | Schell | H01R 13/055 439/850 |
| 2010/0167593 | A1 * | 7/2010 | Yu | H01R 13/055 439/651 |
| 2011/0034084 | A1 * | 2/2011 | Hsueh | H01R 13/506 439/629 |
| 2014/0295680 | A1 * | 10/2014 | YuQiang | H01R 12/724 439/55 |

* cited by examiner

ELECTRICAL CONNECTOR HAVING POWER CONTACTS ASSEMBLED IN A HEIGHT DIRECTION

CROSS REFERENCE TO RELATED APPLICATIONS

The present application claims the priority of Chinese Patent Application No. 202010468940.9, filed on May 28, 2020, the content of which is incorporated herein by reference.

BACKGROUND OF THE INVENTION

1. Field of the Invention

The present invention relates to an electrical connector, and more particularly to an electrical connector with low height.

2. Description of Related Art

A traditional electrical connector uses power terminals with blade-shape in order to improve the surface so that the power terminal can afford to transmit high current. Each power terminal normally has one contacting arm or several contacting arms extending from a blade-shaped body thereof. Multiple power terminals are arranged vertically in a stacked manner in order to carrying higher current.

In addition, in order to make an electrical connection between the electrical connector and a complementary connector more convenient, a height of the electrical connector need to be reduced, therefore the production and assembly of the multiple power terminals becomes more difficult. Take the electrical connector with four power terminals arranged in a height direction as an example, according to the traditional manufacturing process, if a power terminal pair on an upper side is firstly assembled into the insulative housing, then soldering legs of a power terminal pair on a lower side are bent and assembled into the insulative housing, and when a center height of the electrical connector is set to low, the power terminal pair on the upper side will be bent difficultly to form soldering legs extending downward. If the power terminal pair on the upper side is bent to form soldering legs extending downward and then assembled into the insulative housing, an installation space for the power terminal pair on the lower side will be shielded by the soldering legs of the power terminal pair on the upper side, and the power terminal pair on the lower side cannot be assembled into the insulative housing.

Hence, it is desired to provide an electrical connector to overcome the problems mentioned above.

BRIEF SUMMARY OF THE INVENTION

Accordingly, an object of the present invention is to provide an electrical connector with a low height which is convenient for manufacturing and electrically connecting.

The present invention is directed to an electrical connector comprising an insulative housing and a plurality of power contact pairs, the insulative housing has a mounting section for installing on a printed circuit board, a mating section extending forwardly from the mounting section and a plurality of contact-receiving passageways extending along a front-and-back direction. The power contact pairs are retained in corresponding contact-receiving passageways and divided into two rows along a height direction, each power contact pair in each row has two flaky power contacts, each power contact has a retaining portion held in the relative contact-receiving passageway, at least one contacting portion extending forwards from the retaining portion and at least one soldering portion bending from a rear end of the retaining portion. One row of power contact pairs is assembled into the insulative housing along a back-to-front direction, and the other row of power contact pairs is assembled into the insulative housing in an up-and-down direction.

The present invention is also directed to an electrical connector comprising an insulative housing, a plurality of power contacts and a cover assembled to the insulative housing. The insulative housing has a mating section and a mounting section connected with each other in a front-and-back direction, the mating section defines a mating cavity opened forwards, the mounting section has a mounting surface for installing onto a printed circuit board, and in a height direction of the insulative housing, the mounting surface is higher than a bottom surface of the mating section, a top surface of the mounting section is higher than a top surface of the mating section. Each power contact has a retaining portion, at least one contacting portion extending from one end of the retaining portion to the mating cavity and at least one soldering portion extending outside the insulative housing from the other end of the retaining portion. The insulative housing is provided with a plurality of contact-receiving passageways opened upwards, the contact-receiving passageways are defined on the mating section and the mounting section, the cover is arranged at a position of the opening of the contact-receiving passageways along the height direction, and comprises a front cover plate the mating section corresponding to the mating section and a rear cover plate corresponding to the mounting section.

The present invention is also directed to an electrical connector comprising an insulative housing, at least one contact group and a cover. The insulative housing has a plurality of contact-receiving passageways extending along a front-and-back direction, and the contact-receiving passageways is opening to one side of the insulative housing in a height direction perpendicular to the front-and-back direction. Each contact group comprises a first power contact and a second power contact, each one of the first power contact and the second power contact has a retaining portion, at least one contacting portion extending from one end of the retaining portion and at least one soldering portion extending from the other end of the retaining portion, the retaining portions of the first power contact and the second power contact are arranged in the height direction, the contacting portions of the first power contact and the second power contact are arranged in a transverse direction, the soldering portions of the first power contact and the second power contact are arranged in the front-and-back direction. The cover is provided at the opening position of the contact-receiving passageways along the height direction, and the first power contact and second power contact are fixed between the cover and lower walls of the contact-receiving passageways opposite to the cover.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
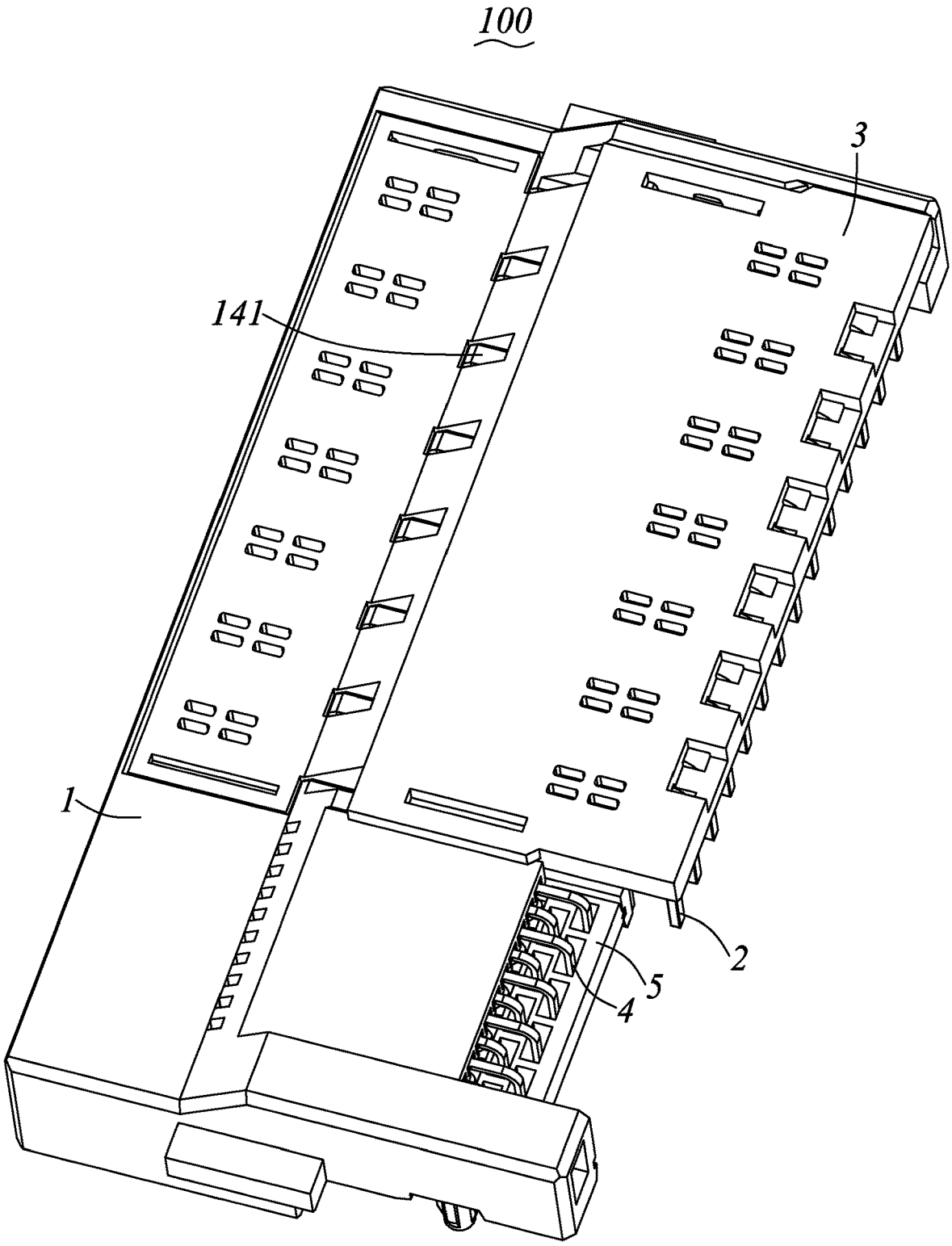
FIG. 1 is a schematic perspective view showing an embodiment of electrical connector according to the present invention.
Figure 2:
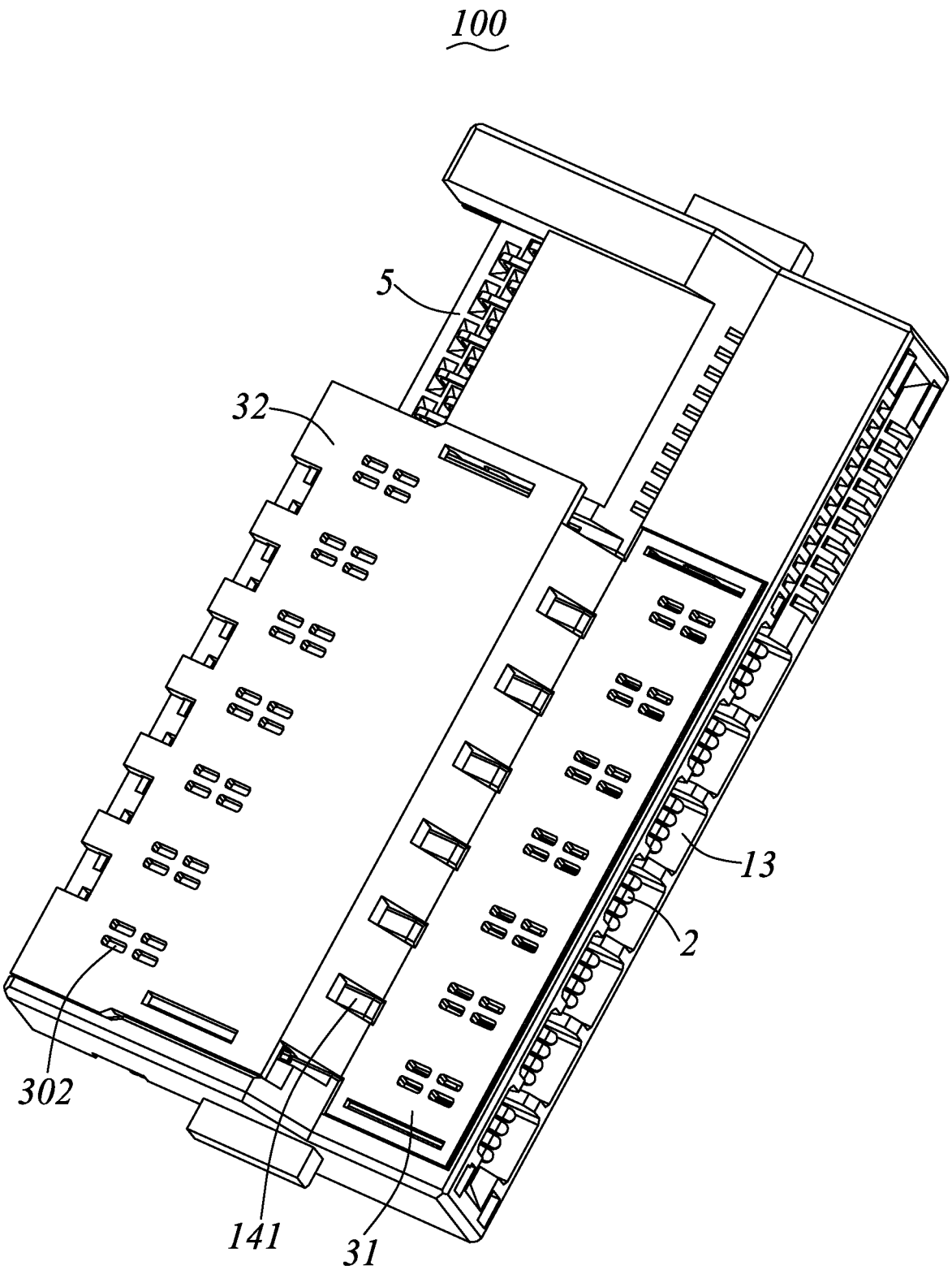
FIGS. 2 to 3 are views similar to FIG. 1, but viewed from another aspects.
Figure 3:
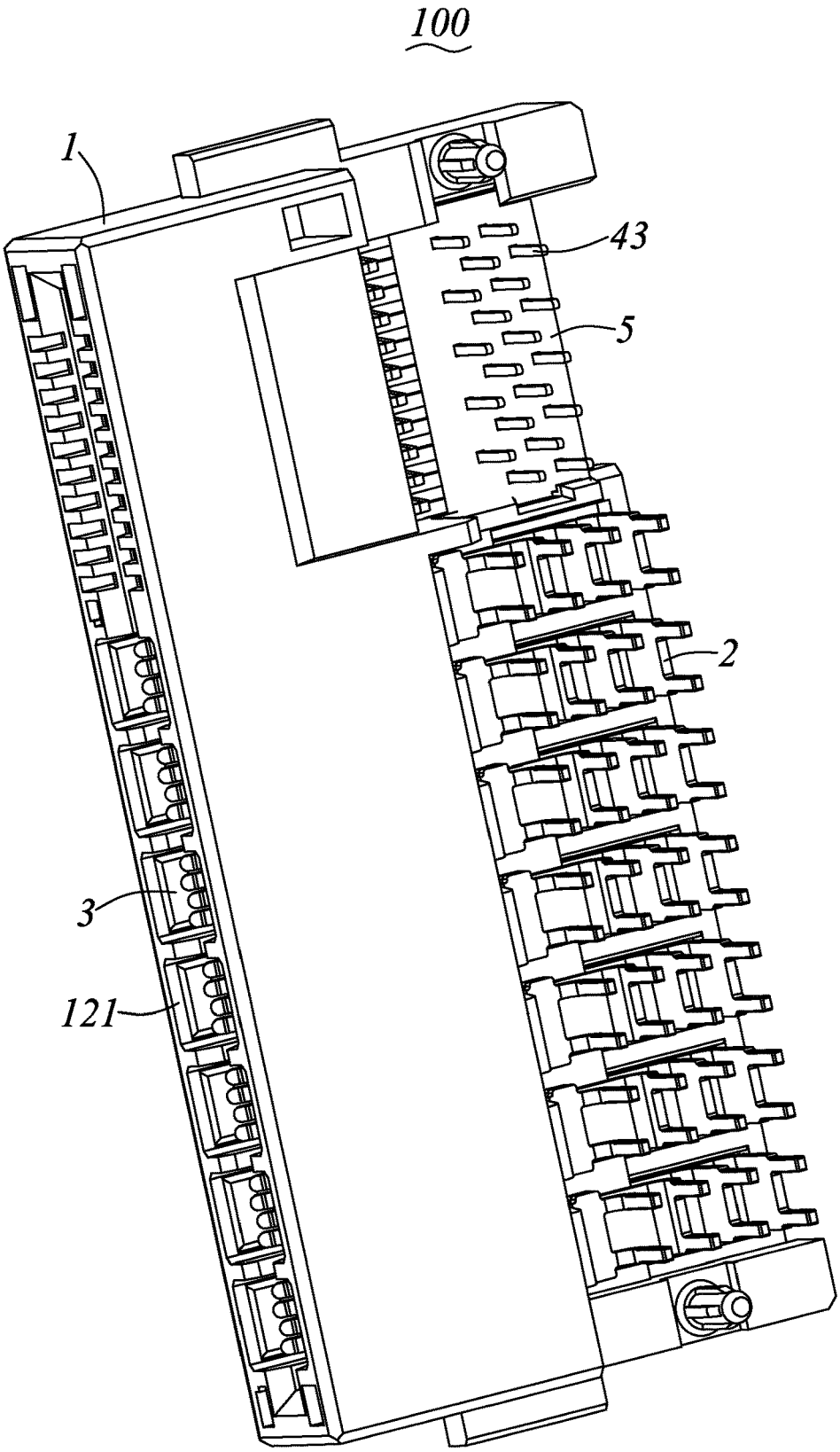
Figure 4:
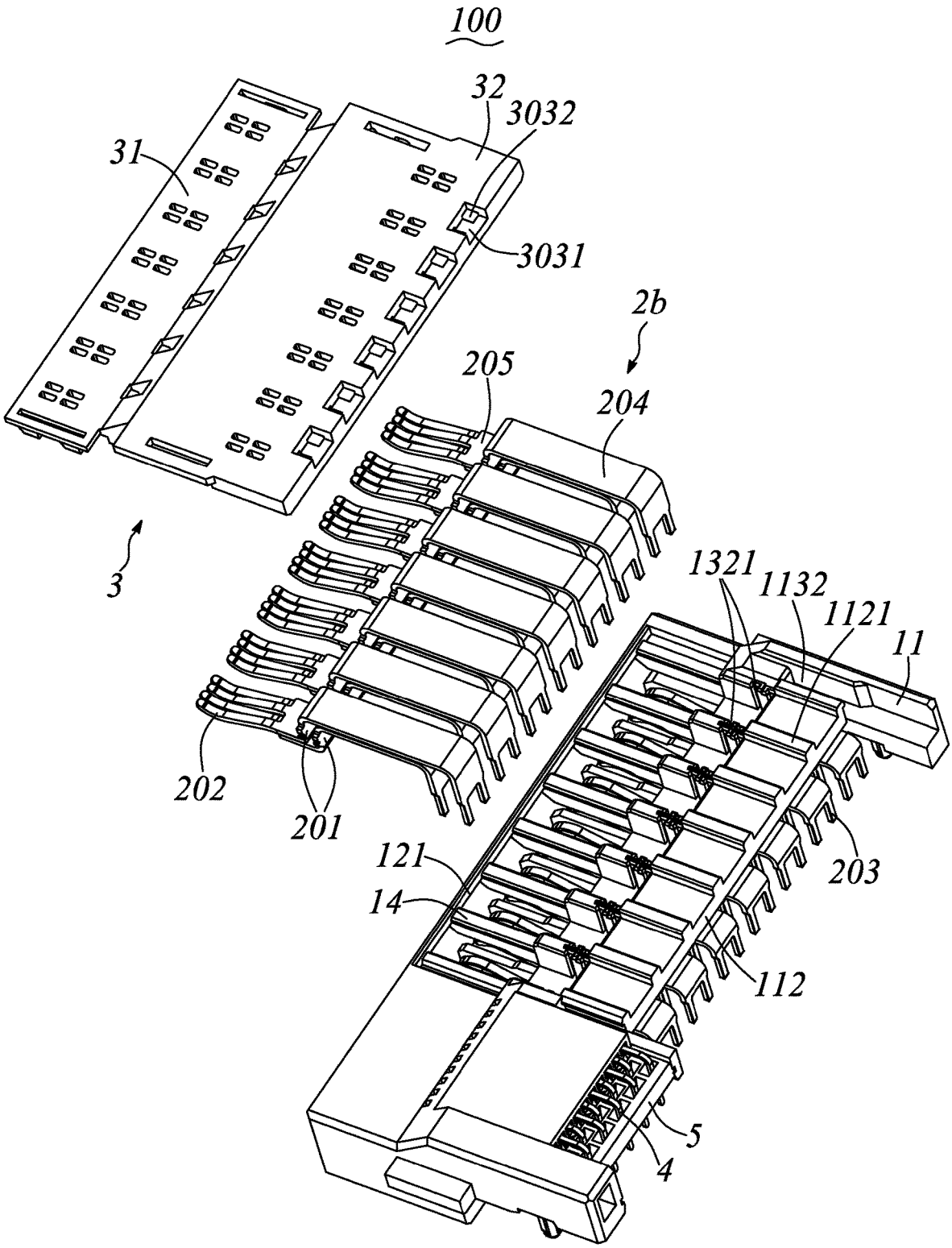
FIG. 4 is a partially exploded view of the electrical connector of FIG. 1.
Figure 5:
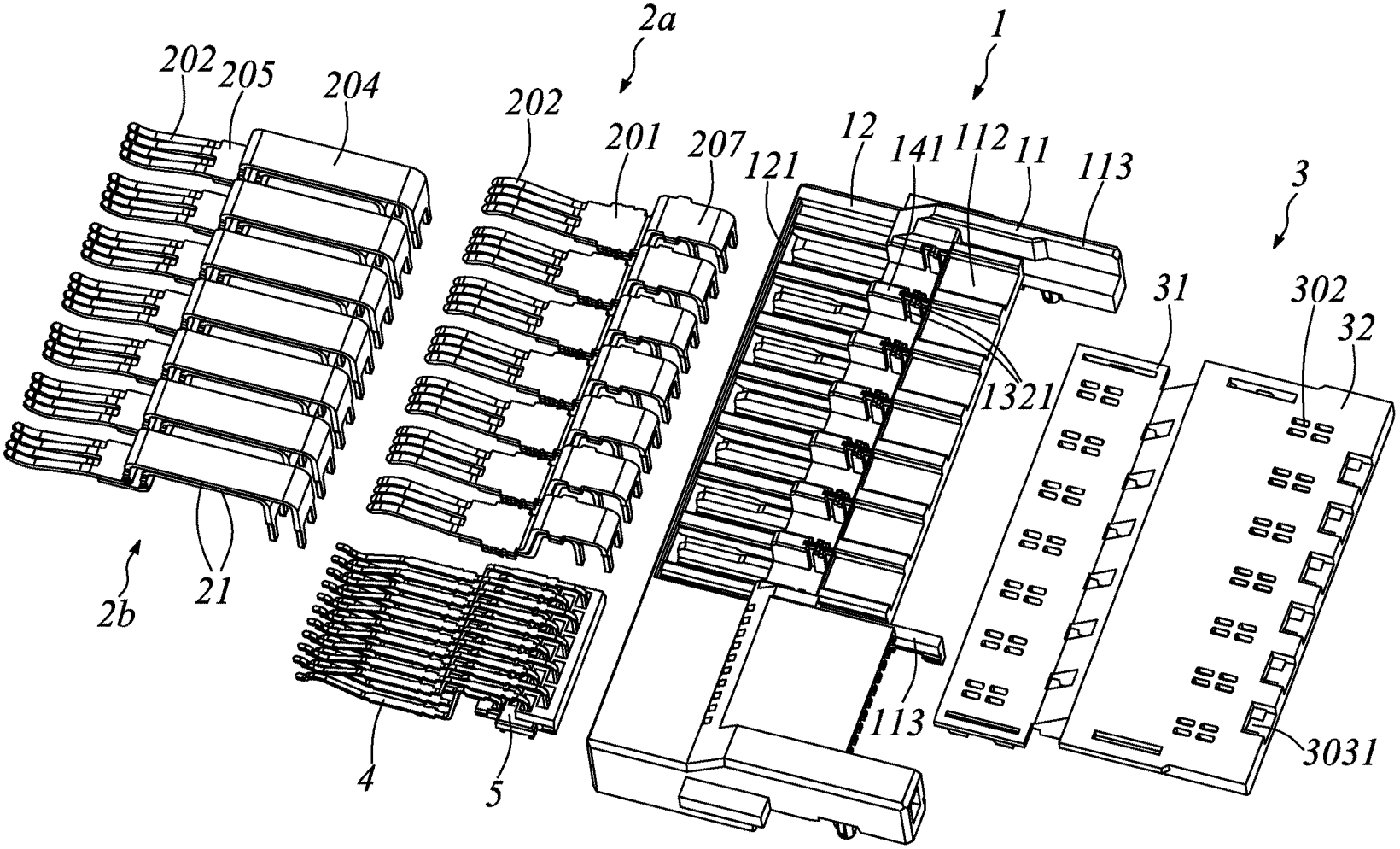
FIG. 5 is a further exploded view of the electrical connector of FIG. 4.
Figure 6:
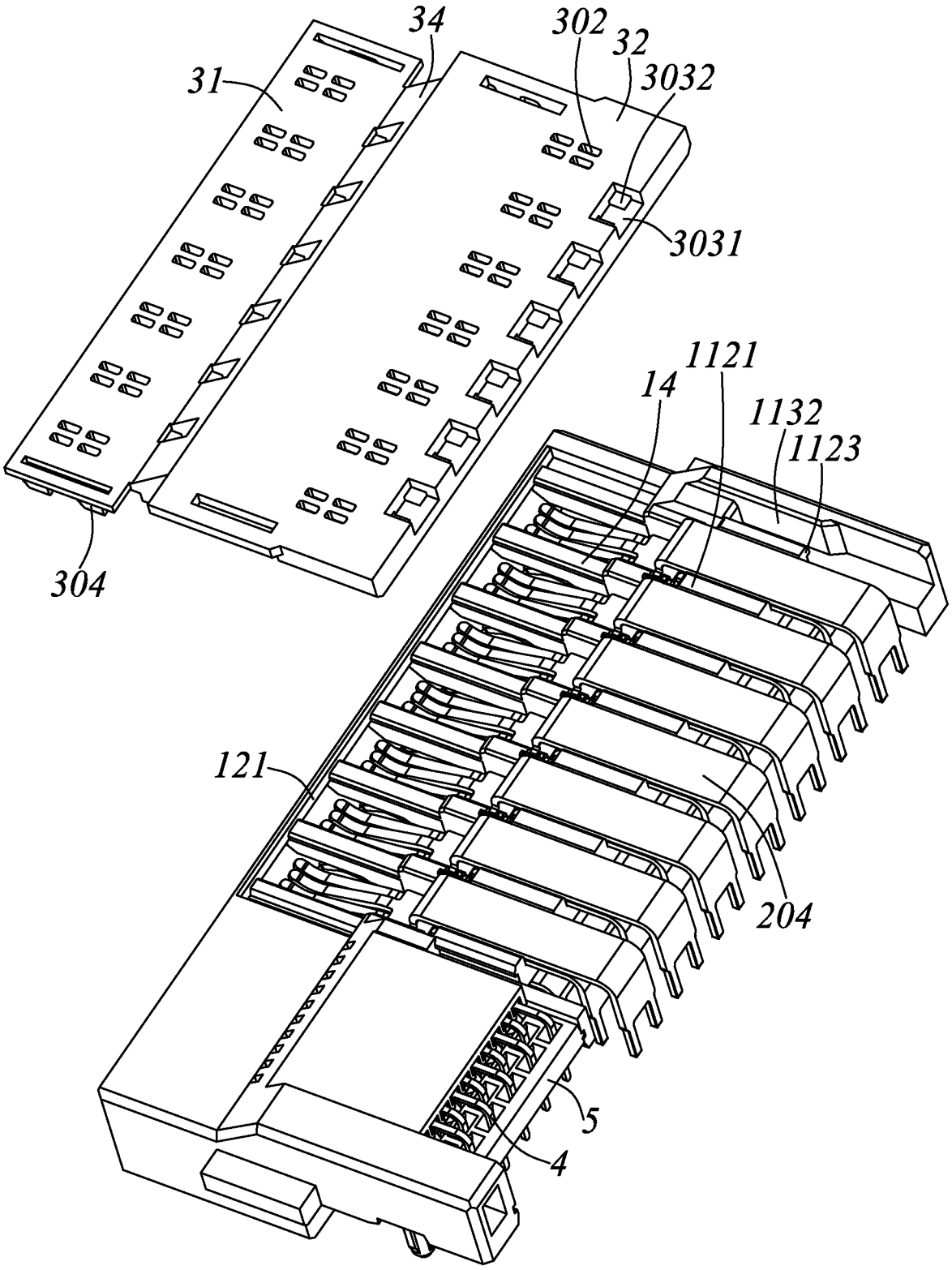
FIG. 6 is a partially assembled view of the electrical connector shown in FIG. 5.
Figure 7:
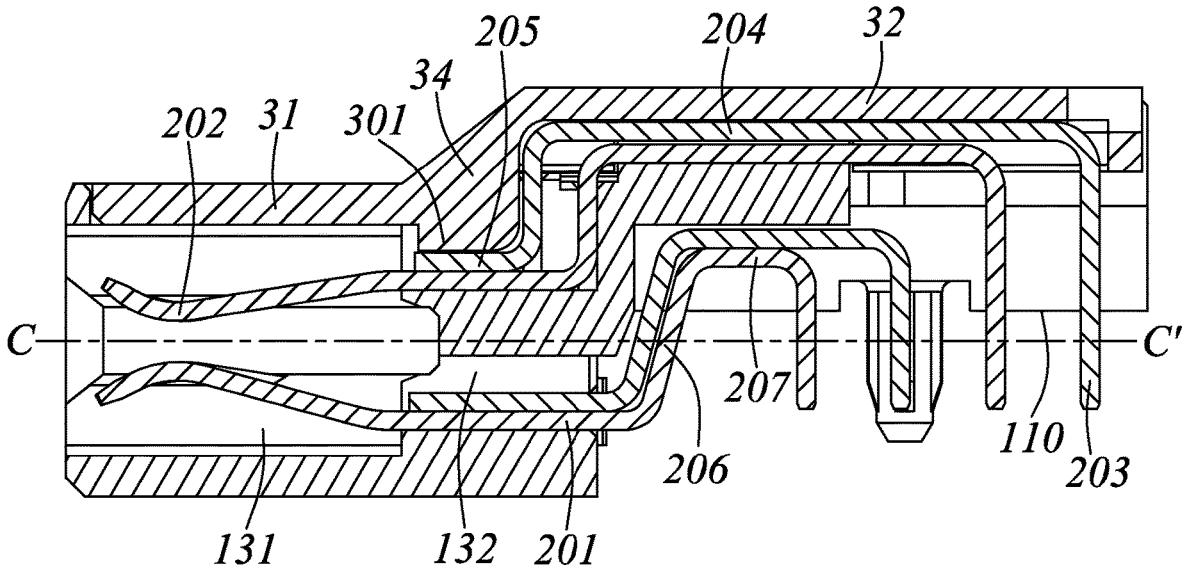
FIGS. 7 to 8 are cross-sectional views of the electrical connector shown in FIG. 1.
Figure 8:
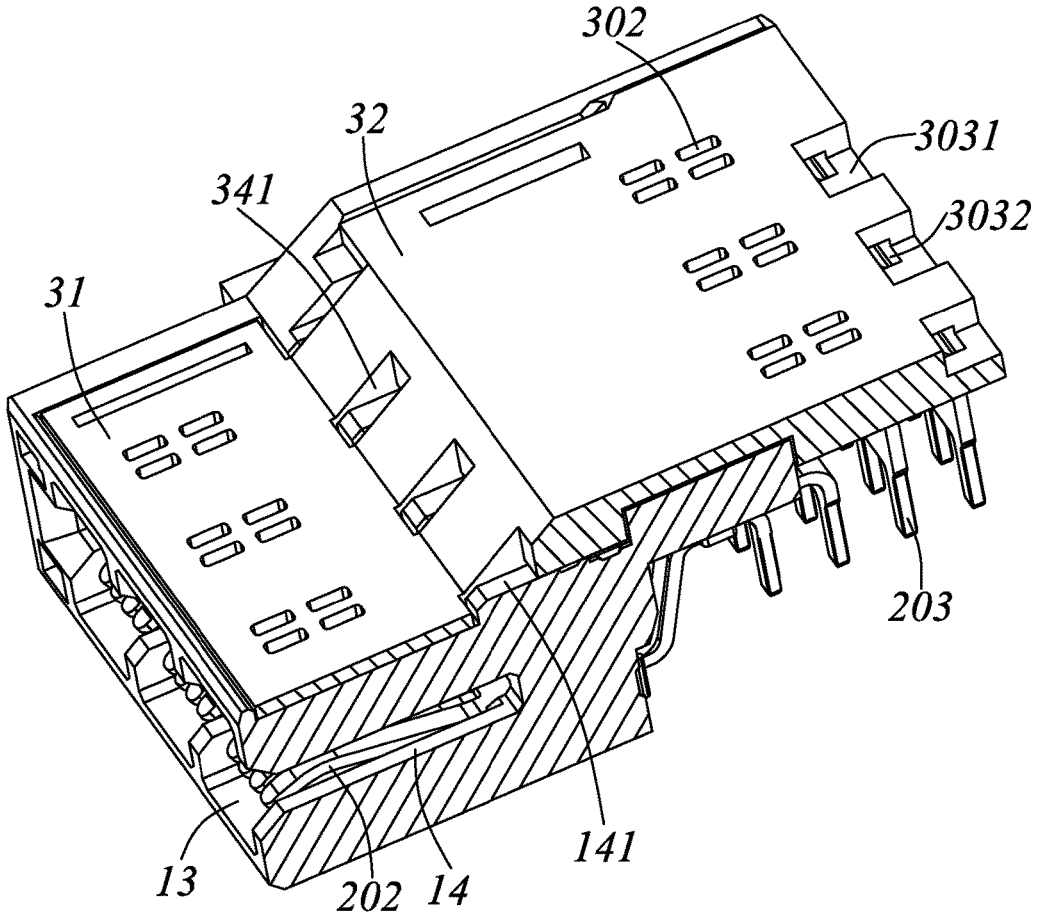
Figure 9:
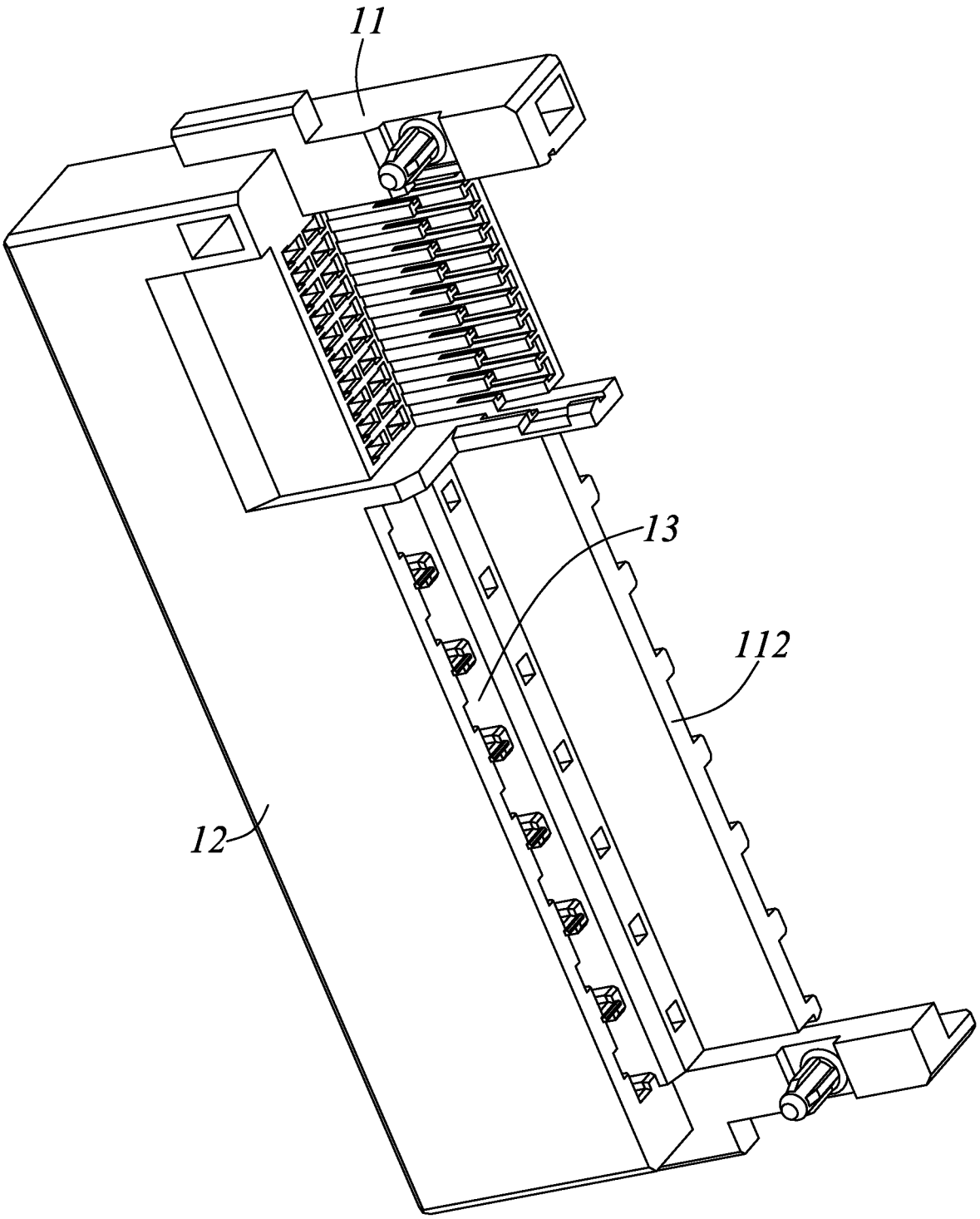
FIG. 9 is a view similar to an insulative housing of the electrical connector shown in FIG. 5, but viewed from another aspect.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-10 illustrate an electrical connector 100 according to a preferred embodiment of the present invention, and the electrical connector 100 comprises an insulative housing 1 and a plurality of power contact pairs 2 held in the insulative housing 1. In order to express convenience, hereinafter, a mating end of the electrical connector 100 is defined as a front end and another end opposite to the mating end is defined as a rear end, that is to say, a front-and-back direction is same as the plugging direction of the electrical connector 100 mating with a complementary member (not shown). At the same time, one direction perpendicular to the front-and-back direction is called as a transverse direction, and another direction perpendicular to the front-and-back direction is called as a height direction or an up-and-down direction. In this embodiment, the insulative housing 1 has a larger dimension in the transverse direction than in the height direction and the front-and-back direction.

As illustrated in FIGS. 1 to 9, in this embodiment, the insulative housing 1 has a mounting section 11 used for mounting on a printed circuit board (not shown), a mating section 12 extending forwardly from the mounting section 11 and a plurality of contact-receiving passageways 13 extending along the front-and-back direction. A barrier 14 is defined between every two neighboring contact-receiving passageways 13 in the transverse direction, each contact-receiving passageway 13 is penetrating through the insulative housing 1 along the front-and-back direction, and each barrier 14 extends along the front-and-back direction too.

Furthermore, the insulative housing 1 has two rows of the contact-receiving passageways 13 arranged at intervals along the height direction, an upper row of contact-receiving passageways 13 are opened outwards in the front-and-back direction and opened upwards, and a lower row of contact-receiving passageways 13 are only opened outwards in the front-and-back direction.

In the present invention, the mating section 12 defines a mating cavity opened forwards, the mounting section 11 has a mounting surface 110 for installing onto the printed circuit board. In the height direction, the mounting surface 110 is not lower than a horizontal center plane C-C' of the mating section 12, to reduce the overall height of the electrical connector 100, and the electrical connector 100 can have a low center height for electrical connection with the complementary member.

Specifically, in the present embodiment, the mounting section 11 includes a supporting wall 112 and a pair of extending portions 113 on both sides of the supporting wall 112 in the transverse direction, and in the height direction, the lower row of contact-receiving passageways 13 are located under the supporting wall 112. The supporting wall 112 is plate-shaped as a whole and defines a plurality of dividers 1121 arranged in the transverse direction, and each extending portion 113 extends backward and beyond the supporting wall 112, and the mounting surface 110 is a bottom surface of the extending portions 113.

Each extending portion 113 has a receiving slot 1132 which is depressed downwards from a top surface thereof, and the supporting wall 112 defines a pair of locking portions 1123 protruding outwards from both sides thereof in the transverse direction, and each locking portion 1123 protrudes into the corresponding receiving slot 1132 on a same side.

The mating section 12 has a front wall 121 located at its front end and extending laterally, the front wall 121 is located on an upper side of the mating section 12 and connected to the barriers 14. The barriers 14 are perpendicular to the front wall 121 and exposed on the mating section 12. Additionally, each barrier 14 has a limiting projection 141 protruding upwardly, thus a number of limiting projections 141 are formed on an upper side of the insulative housing 1, and each limiting projection 141 is located between two adjacent contact-receiving passageways 13.

In present embodiment, each contact-receiving passageway 13 includes a first groove 131 and a second groove 132 communicated with each other. The first groove 131 is located in front of the second groove 132 to receive contacting portions 202 of corresponding power contact pair 2, the second groove 132 is behind the first groove 131 to receive and fix retaining portions 201 of corresponding power contact pair 2. Each second groove 132 of the contact-receiving passageways 13 in the upper row defines two pairs of retaining slots 1321 on both sides in the transverse direction thereof, and two retaining slots 1321 in each pair are provided opposite to each other in the transverse direction. Two retaining slots 1321 located on a same side are spaced apart from in the front-to-back direction, and each retaining slot 1321 is of an elongated strip extending in the height direction.

Referring to FIGS. 2-8, the power contact pairs 2 are received in the corresponding contact-receiving passageways 13 and divided into at least two rows along the height direction, i.e., the power contact pairs in an upper row and the power contact pairs in a lower row. In the present embodiment, the power contact pairs 2 are arranged in pairs along the height direction to form a group, and two power contact pairs 2 in each group are opposite to each other in the height direction and arranged at intervals.

Each power contact pair 2 in each row includes two power contacts 21, each power contact 21 has one retaining portion 201 held in the relative contact-receiving passageway 13, at least a pair of contacting portions 202 extending forwards from the retaining portion 201 and at least a soldering portion 203 bending from a rear end of the retaining portion 201.

Each contacting portion 202 is formed with a curved shape and protrudes towards the horizontal center plane C-C' of the mating section 12. The contacting portions 202 of two power contacts 21 in each power contact pair 2 are lined up in a row along the height direction, and arranged alternately and circularly. Of course, the contacting portions 202 of two power contacts 21 in each power contact pairs 2 also can be misaligned along the height direction. As long as the contacting portions 202 of two power contacts 21 in each power contact pairs 2 are located on a same horizontal plane when the electrical connector 100 mating with the complementary member.

In assembly, one row of power contact pairs 2*a* are assembled into the insulative housing 1 along a back-to-front direction, and the other row of power contact pairs 2*b* are assembled into the insulative housing 1 in the up-and-down direction, and the one row of power contact pairs 2*a* are located on a lower side of the supporting wall 112, and the other row of power contact pairs 2*b* are located on an upper side of the supporting wall 112.

In further, in present embodiment, the one row of power contact pairs 2*a* are the power contact pairs in the lower row, and the other row of power contact pairs 2*b* are the power contact pairs in the upper row. Moreover, the retaining portion 201 of each power contact 21 of the power contact pairs 2 in the upper row extends in the up-and-down direction, and the retaining portion 201 of each power contact 21 of the power contact pair 2 in the lower row extends in the front-to-back direction. In other embodiments of the invention, the power contact pairs 2 in the lower row also can be inserted into the insulative housing 1 in the up-and-down direction while the power contact pairs 2 in the upper row inserted into the insulative housing 1 in the front-to-back direction.

The retaining portions 201 of two power contacts 21 in pairs of the other row of power contact pairs 2*b* are parallel and spaced apart from each other along the front-to-back direction, to interferentially engage with the corresponding retaining slots 1321 in the contact-receiving passageway 13, the retaining portions 201 are perpendicular to the mounting surface 110 preferably, so that the other row of power contact pairs 2*b* are smoothly fixed into the insulative housing 1.

Two power contacts 21 in each power contact pair 2 are received together in a same contact-receiving passageway 13, and each power contact 21 in the other power contact pairs 2*b* has a first horizontal portion 204 and a second horizontal portion 205 parallel to each other, the first horizontal portion 204 and the second horizontal portion 205 are connected to a top end and a bottom end of the retaining portion 201 respectively. The first horizontal portion 204 and the second horizontal portion 205 are defined as a plate-shaped structure which is parallel to a horizontal plane, the soldering portions 203 are bent downwards from a rear end of the first horizontal part 204, and the soldering portions 203 of each row of the power contact pairs 2 are divided into two groups aligned in a line along the transverse direction respectively.

In the one row of power contact pairs 2*a*, the retaining portion 201 of each power contact 21 extends backwards from its contacting portion 202, and the retaining portion 201 is a sheet-like structure extending in a horizontal direction. Each power contact 21 further has a first bending portion 206 bending upwardly from a rear end of its retaining portion 201 and a second bending portion 207 extending backwardly from a top end of the first bending portion 206, the soldering portions 203 of each power contact 21 are bent downward from a rear end of the second bending portion 207, the first bending portion 206 is provided at an angle to the height direction. The retaining portions 201 of two power contacts 21 in each power contact pair 2 are stacked with each other in the height direction and the second bending portions 207 are stacked with each other in the height direction.

In the embodiment illustrated by the invention, each power contact 21 has two contact portions 202 extending forwards, and in other embodiments, each power contact 21 also can have three or more contact portions 202.

Figure 10:
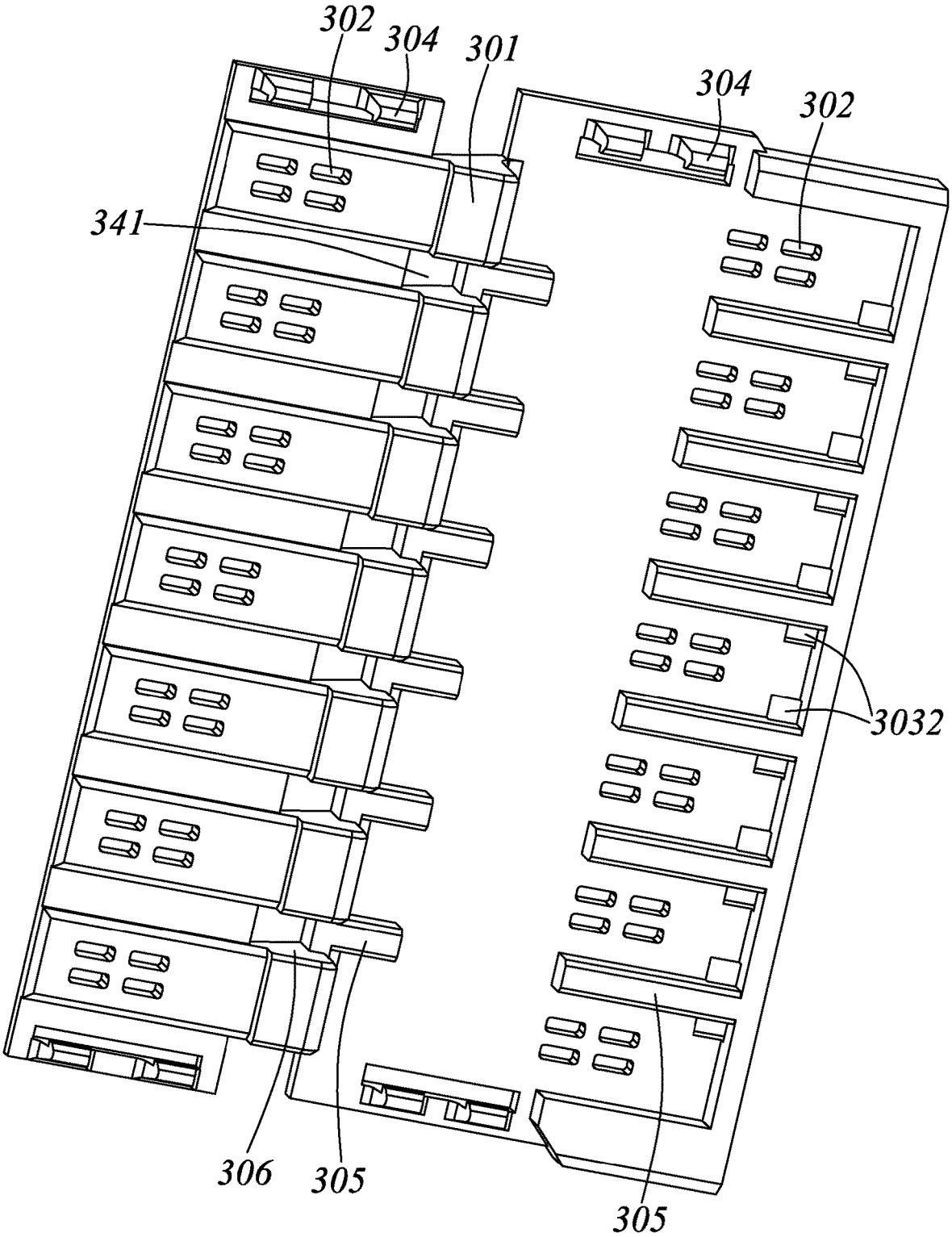
FIG. 10 is a view similar to a cover of the electrical connector shown in FIG. 5, but viewed from another aspect.

Referring to FIGS. 1-8 and conjunction with FIG. 10, the electrical connector 100 further has a cover 3 assembled and fixed to the insulative housing 1, after the power contact pairs 2 assembled into the insulative housing 1, the cover 3 is assembled to the insulative housing 1 along the up-and-down direction and adjacent to the other row of power contact pairs 2*b*, thereby isolating the power contact pairs 2 from an exterior on an upper side of the power contact pairs 2, and providing auxiliary fixation to the power contact pairs 2.

The contact-receiving passageways 13 corresponding to the other row of power contact pairs 2*b* are opened outwards in the up-and-down direction, the cover 3 defines an inner side close to the other row of power contact pairs 2*b* and an outer side opposite to the inner side, the inner side of the cover 3 is provided with a plurality of resisting portions 301 which abutting against the other row of power contact pairs 2*b*.

The cover 3 comprises a front cover plate 31, a rear cover plate 32 and a conjoining plate 34 connecting the front cover plate 31 and the rear cover plate 32. The front cover plate 31 covers an outer side of the mating section 12, the rear cover plate 32 covers an outer side of the mounting section 11, and the conjoining plate 34 is provided with a number of limiting slots 341 for receiving and positioning the corresponding limiting projections 141.

Moreover, the cover 3 has a plurality of heat dissipation slots 302 penetrating through it in the height direction and communicated with the corresponding contact-receiving passageways 13. Further, the front cover plate 31 is provided with two rows of the heat dissipation slots 302, and the rear cover plate 32 is also provided with two rows of heat dissipation slots 302. The cover 3 further has a plurality of depressions 3031 at a back segment and a plurality of heat dissipation holes 3032 communicated with corresponding depressions 3031, each depression 3031 is recessed downwards from a top surface of the cover 3 and corresponding to two heat dissipation holes 3032, thus forming a through heat dissipation structure at the rear segment of the cover 3.

Further, the cover 3 is provided with at least one pair of latch portions 304 on the inner side thereof, and the locking portions 1123 of the insulative housing 1 are cooperated with the corresponding latch portions 304.

The cover 3 further defines a plurality of projections 305 protruding towards the insulative housing 1 on the inner side thereof, every two neighboring resisting portions 301 are spaced apart from each other in the transverse direction to form a spacing slot 306, and each projection 305 is aligned with the corresponding spacing slot 306 in the front-and-rear direction. Each protrusion 305 is located between two adjacent power contact pairs 2, in this way, not only the strength of cover 3 can be increased, but also the arc creepage distance between adjacent power contacts 21 can be increased. In present embodiment, the cover 3 has two sets of the projections 305 spaced along the front-to-back direction, and two sets of the projections 305 are aligned along the front-to-back direction. In a rear set of the projections 305, at least one heat dissipation slot 302 is sandwiched between every two adjacent projections 305.

When assembling, each power contact 21 of the power contact pairs 2 in the lower row are bent to form the soldering portions 203 firstly, then two power contacts 21 are stacked with each other and inserted into the insulative housing 1 in the front-and-back direction, after that the two power contacts 21 of each power contact pair 2 in the upper row are inserted into the insulative housing 1 in the height direction in turn. Certainly, the two power contacts 21 of each power contact pair 2 in the upper row also can be stacked together and then inserted into the insulative housing 1. Finally, the cover 3 is assembled to the upper side of the insulative housing 1 in an up-and-down direction to cover and further fix the power contact pairs 2, so as to realize automatic production, improve production efficiency and reduce production difficulties.

As illustrated in FIGS. 1 to 6, in present embodiment, the electrical connector 100 further has a number of signal contacts 4 located on one of the sides of the power contact pairs 2 in the transverse direction and a spacer 5 assembled to the insulative housing 1 for retaining the tails 43 of the signal contacts 4.

The electrical connector 100 in present invention have a low center height in order to mate with the complementary member electrically. One row of the power contact pairs 2*a* of the electrical connector 100 is assembled to the insulative housing 1 along the back-to-front direction, another row of the power contact pairs 2*b* is assembled to the insulative housing 1 along the up-and-down direction, thus problems caused to each other when the two rows of power contact pairs 2 are installed in the same direction can be avoided, the production difficulty and cost of the electrical connector 100 can be reduced. Therefore the electrical connector 100 be able to transmit large current with a lower overall height and a lower center height, and meanwhile it also resolves the problem that the multiple rows of power contacts are difficult to assemble into the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a mounting section for installing on a printed circuit board, a mating section extending forwardly from the mounting section and a plurality of contact-receiving passageways extending along a front-and-back direction;

a plurality of power contact pairs retained in corresponding contact-receiving passageways of the insulative housing and divided into two rows along a height direction, each power contact pair in each row having at least two flaky power contacts, each power contact having a retaining portion held in the relative contact-receiving passageway, at least one contacting portion extending forwards from the retaining portion and at least one soldering portion bending from a rear end of the retaining portion; and wherein one row of power contact pairs is assembled into the insulative housing along a back-to-front direction, and another row of power contact pairs is assembled into the insulative housing in an up-and-down direction.

2. The electrical connector as claimed in claim 1, wherein the retaining portion of each power contact of the power contact pairs in an upper row extends in the up-and-down direction, and the retaining portion of each power contact of the power contact pair in a lower row extends in the front-to-back direction.

3. The electrical connector as claimed in claim 1, wherein the electrical connector further has a cover assembled and fixed to the insulative housing, after the power contact pairs assembled into the insulative housing, the cover is assembled to the insulative housing along the up-and-down direction and adjacent to the other row of power contact pairs.

4. The electrical connector as claimed in claim 3, wherein the contact-receiving passageways corresponding to the other row of power contact pairs are opened outwards in the up-and-down direction, the cover defines an inner side close to the other row of power contact pairs and an outer side opposite to the inner side, the inner side of the cover is provided with a plurality of resisting portions which abutting against the other row of power contact pairs.

5. The electrical connector as claimed in claim 4, wherein the cover comprises a front cover plate, a rear cover plate and a conjoining plate connecting the front cover plate and the rear cover plate, the front cover plate covers an outer side of the mating section, the rear cover plate covers an outer side of the mounting section.

6. The electrical connector as claimed in claim 5, wherein the insulative housing defines a of limiting projections, and each limiting projection is located between two adjacent contact-receiving passageways, the conjoining plate is provided with a plurality of limiting slots for receiving and positioning the corresponding limiting projections.

7. The electrical connector as claimed in claim 1, wherein the retaining portions of two power contacts in pairs of the other row of power contact pairs are parallel and spaced apart from each other along the front-to-back direction, to interferentially engage with corresponding retaining slots in the contact-receiving passageway.

8. The electrical connector as claimed in claim 7, wherein each contact-receiving passageway in an upper row defines two pairs of retaining slots on both sides in a transverse direction, and two retaining slots in each pair are provided opposite to each other in the transverse direction, two retaining slots on a same side are spaced apart from in the front-to-back direction, and each retaining slot is of an elongated strip extending in the height direction.

9. The electrical connector as claimed in claim 1, wherein two power contacts in each power contact pair are received together in a same contact-receiving passageway, and each power contact in the other power contact pairs has a first horizontal portion and a second horizontal portion parallel to each other, the first horizontal portion and the second horizontal portion are connected to a top end and a bottom end of the retaining portion respectively.

10. The electrical connector as claimed in claim 3, wherein the cover has a plurality of heat dissipation slots penetrating through it in the height direction and communicated with the corresponding contact-receiving passageways.

11. The electrical connector as claimed in claim 3, wherein the cover is provided with at least one pair of latch portions on an inner side thereof, the insulative housing defines a pair of locking portions protruding outwards from both sides thereof in a transverse direction and cooperated with the corresponding latch portions.

12. The electrical connector as claimed in claim 3, wherein the mounting section comprises a supporting wall and a pair of extending portions on both sides of the supporting wall in a transverse direction, and in the height direction, a lower row of contact-receiving passageways is located under the supporting wall.

13. The electrical connector as claimed in claim 4, wherein the cover further defines a plurality of projections protruding towards the insulative housing on the inner side thereof, every two neighboring resisting portions are spaced apart from each other in a transverse direction to form a spacing slot, and each projection is aligned with the corresponding spacing slot in the front-and-rear direction.

14. An electrical connector, comprising:

an insulative housing having at least one contact-receiving passageway extending along a front-and-back direction, and the contact-receiving passageway opening to one side of the insulative housing in a height direction perpendicular to the front-and-back direction;

at least one contact group assembled to the contact-receiving passageway of the insulative housing along the height direction and each of which comprising at least a first power contact and at least a second power contact, each one of the first power contact and the second power contact having a retaining portion held in the contact-receiving passageway, at least one contacting portion extending from one end of the retaining portion and at least one soldering portion extending from the other end of the retaining portion, the retaining portions of the first power contact and the second power contact arranged in the height direction, the contacting portions of the first power contact and the second power contact arranged in a transverse row, the soldering portions of the first power contact and the second power contact arranged in the front-and-back direction.

15. The electrical connector as claimed in claim 14, further comprising a cover, wherein the cover covering the opening position of the contact-receiving passageway along the height direction after the contact group being installed in the contact-receiving passageway.

16. The electrical connector as claimed in claim 15, wherein the electrical connector further has at least one other contact group assembled to the insulative housing in the front-and-back direction, each of the at least one another contact group defines a third power contact and a fourth power contact, the retaining portions of the third power contact and the fourth power contact arranged in the height direction, the contacting portions of the third power contact and the fourth power contact arranged in a transverse row, the soldering portions of the third power contact and the fourth power contact arranged in the front-and-back direction.

17. The electrical connector as claimed in claim 14, the insulative housing has a mating section and a mounting section connected with each other in a front-and-back direction, the mating section defines a mating cavity opened forwards, the mounting section has a mounting surface for installing onto a printed circuit board, and in a height direction of the insulative housing, the mounting surface is higher than a bottom surface of the mating section, a top surface of the mounting section is higher than a top surface of the mating section.

* * * * *